US011707642B2

(12) United States Patent
Fourney

(10) Patent No.: US 11,707,642 B2
(45) Date of Patent: Jul. 25, 2023

(54) APPARATUS FOR SUPPORTED ROW EXERCISE

(71) Applicant: Blair Fourney, East Meadow, NY (US)

(72) Inventor: Blair Fourney, East Meadow, NY (US)

( * ) Notice: Subject to any disclaimer, the term of this patent is extended or adjusted under 35 U.S.C. 154(b) by 0 days.

(21) Appl. No.: 17/103,265

(22) Filed: Nov. 24, 2020

(65) Prior Publication Data

US 2022/0161092 A1 May 26, 2022

(51) Int. Cl.
*A63B 21/00* (2006.01)
*A63B 21/078* (2006.01)

(52) U.S. Cl.
CPC ..... *A63B 21/4033* (2015.10); *A63B 21/078* (2013.01); *A63B 2225/093* (2013.01)

(58) Field of Classification Search
CPC ..... A63B 21/00047; A63B 21/0615; A63B 21/0616; A63B 21/0617; A63B 21/078; A63B 21/0783; A63B 21/08; A63B 21/15; A63B 21/159; A63B 21/4027; A63B 21/4029; A63B 21/4033; A63B 21/4039; A63B 23/02; A63B 23/0205; A63B 23/0216; A63B 23/0233; A63B 23/12; A63B 23/1209; A63B 69/0057; A63B 71/0054; A63B 2071/0072; A63B 2208/0242; A63B 2208/0257; A63B 2208/0261; A63B 2225/09; A63B 2225/093
See application file for complete search history.

(56) References Cited

U.S. PATENT DOCUMENTS 4,258,913 A * 3/1981 Brentham ..... A63B 21/0083 482/45
4,286,782 A * 9/1981 Fuhrhop ..... A63B 23/00 482/99
4,620,701 A * 11/1986 Mojden ..... A63B 3/00 482/142
4,854,578 A * 8/1989 Fulks ..... A63B 21/4035 482/136
4,893,812 A * 1/1990 Dawson, Jr. ..... A63B 21/154 482/94
5,201,694 A * 4/1993 Zappel ..... A63B 23/0405 482/133
5,312,313 A * 5/1994 Holmes ..... A63B 23/12 482/95

(Continued)

FOREIGN PATENT DOCUMENTS

KR 20210018741 A * 8/2019 ..... A63B 23/0482
KR 20210030564 A * 9/2019 ..... A63B 23/0482

OTHER PUBLICATIONS https://www.sorinex.com/products/the-bulldog-pad.

*Primary Examiner* — Gary D Urbiel Goldner
(74) *Attorney, Agent, or Firm* — Christopher B. McKinley

(57) ABSTRACT

An exercise device configured to provide for a lifter performing a bent-over row exercise. The exercise device provides lower back support and stability to the lifter. Embodiments of the device may be attachable to an exercise rack or be configured as a standalone device. An embodiment of the exercise device may comprise an adjustable support pad configured to support the chest of a lifter. The adjustable support pad rotates about an axis to optimize comfort and alleviate lower back strain during bent-over row exercises.

10 Claims, 7 Drawing Sheets

(56) References Cited

U.S. PATENT DOCUMENTS 5,476,433 A * 12/1995 Bruner ..... A63B 69/004 482/90
5,540,643 A * 7/1996 Fontaine ..... A61H 1/0229 482/904
5,813,951 A * 9/1998 Einsig ..... A63B 21/0615 482/110
6,547,704 B2 * 4/2003 Parrillo ..... A63B 23/035 482/94
6,685,601 B1 * 2/2004 Knapp ..... A63B 21/0783 482/142
6,702,724 B2 * 3/2004 Taylor ..... A63B 21/0628 482/52
7,128,701 B1 * 10/2006 Ketcham ..... A63B 21/00047 482/148
7,455,634 B2 * 11/2008 Barniak ..... A63B 3/00 482/96
7,670,271 B2 * 3/2010 Finch ..... A63B 23/0216 482/143
9,302,149 B1 * 4/2016 Parker ..... A63B 21/00047
10,737,134 B2 * 8/2020 Anderson ..... A63B 21/4034
D907,726 S * 1/2021 Gluba ..... D21/694
11,369,833 B2 * 6/2022 Leipheimer ..... A63B 21/4043
2007/0161470 A1 * 7/2007 Berryman ..... A63B 69/3629 482/100
2008/0113852 A1 * 5/2008 Caldwell ..... A63B 23/03541 482/133
2009/0069161 A1 * 3/2009 Caldwell ..... A63B 21/4035 482/142
2009/0143203 A1 * 6/2009 Knapp ..... A63B 23/0355 482/104
2009/0170675 A1 * 7/2009 Giannelli ..... A63B 23/03541 482/139
2011/0294630 A1 * 12/2011 Reyes ..... A63B 23/0405 482/121
2012/0238418 A1 * 9/2012 Reyes ..... A63B 21/00072 482/121
2013/0296143 A1 * 11/2013 Staten ..... A63B 21/078 482/98
2013/0310232 A1 * 11/2013 Flores ..... A63B 23/0216 482/131
2014/0080685 A1 * 3/2014 Butler ..... A63B 21/154 482/102
2014/0135182 A1 * 5/2014 Inglut ..... A63B 23/1227 482/96
2014/0135183 A1 * 5/2014 Inglut ..... A63B 23/1227 482/96
2014/0274620 A1 * 9/2014 Hoole ..... A63B 21/4007 482/141
2014/0323277 A1 * 10/2014 Doane ..... A63B 69/10 482/142
2015/0011370 A1 * 1/2015 Henniger ..... A63B 23/0211 482/145
2018/0161657 A1 * 6/2018 Direnzo ..... A63B 69/0002
2018/0229072 A1 * 8/2018 Staten ..... A63B 21/4029
2018/0243597 A1 * 8/2018 Schlegel ..... A63B 17/04
2018/0279793 A1 * 10/2018 Derecktor ..... A47C 9/005
2019/0275363 A1 * 9/2019 Jones ..... A63B 21/0616
2020/0101348 A1 * 4/2020 Davis ..... A63B 23/0482
2020/0206558 A1 * 7/2020 Lefkovitz ..... A61H 3/04
2021/0038940 A1 * 2/2021 Marti ..... A63B 21/4049
2021/0038941 A1 * 2/2021 Marti ..... A63B 23/03533
2021/0170218 A1 * 6/2021 Lewis-Dove ..... A63B 21/06
2021/0299511 A1 * 9/2021 Miller ..... A63B 21/4047

* cited by examiner

APPARATUS FOR SUPPORTED ROW EXERCISE

BACKGROUND OF THE INVENTION

The present disclosure generally relates to an exercise device that, through its unique design, is adapted to provide support during free weight exercises, such as row exercises.

Free weight lifting is a resistance-based, strength training method of choice for many athletes, bodybuilders, and fitness enthusiasts. Compared to many machine exercises, free weight lifting promotes greater range of motion during lifting, which tends to increase muscle activation. One popular free weight exercise is the row exercise, which strengthens a number of back muscles, including the latissimus dorsi, trapezius, and rhomboids. A row exercise is a pulling motion that generally consists of moving one or both arms from a straightened, outright position to a bent, retracted position against resistance, such as while holding one or more free weights. To perform a bent-over row exercise, an individual stands with both feet on the floor, bends forward at the hips to achieve a bent-over position, and performs the row movement with a barbell, dumbbells, weights, or other forms of resistance.

Notably, the bent-over row position places stress on the lifter's lower back, which could cause pain and ultimately lead to injury. In fact, back injuries and lower back pain from free weight exercises like bent-over row exercises are not uncommon. Individuals performing free weight exercises, particularly novices, are more susceptible to injuries because they lack the proper form to execute the lift safely.

Traditionally, to avoid back injury, lifters are sometimes assisted by a spotter (i.e., another person helping to move the weight). The spotter can position themselves near the lifter's hands or the bar in order to assist the lifter in performing a weighted row exercise. The spotter may also assist the lifter in returning the weight or weights to their starting position, thereby reducing the risk of injury. However, solo lifters do not have the benefit of spotters. Also, it is often difficult for the spotter to know when and when not to assist the lifter, so it requires a certain degree of coordination that further complicates the lift.

Certain devices purport to support an individual during free weight row exercises. A flat bench, for example, can be used to assist lifters in performing what is known as a dumbbell row. In performing this exercise, a lifter uses the flat bench to support one hand and one knee, while performing the row with the other hand. However, this exercise only allows the lifter to perform the row with one arm at a time, doubling the amount of time necessary to complete the exercise. Further, the use of a bench can cause stability issues as the lifter may compensate for the heavy weight by twisting the torso when performing the row, resulting in injury to the back or shoulders. Twisting also leads to a less effective muscle activation in the targeted back muscles, which prevents optimal muscle development. Moreover, absent chest support, the lifter may round their back, increasing the risk of back injury.

Another device that purports to support a lifter during free weight row exercises is a seal row bench, which is an elevated bench that allows a lifter to lie prone on to access free weights placed underneath the bench. However, a seal row does not allow for proper row exercise motion, as the bench impedes full retraction of the weight towards the body. Moreover, lifting heavy loads while in a prone position puts the lifter at risk of chest and abdominal pain and injury. Further, when performing a seal row, a lifter's face is either pressed into the seal row, turned to the side, or raised above the top of the bench, all of which increase the risk of discomfort or injury. Thus, existing devices have proven insufficient at eliminating injury and ensuring proper form.

Traditional exercise racks (sometimes referred to a as power or squat racks or cages) allow for the connection of a variety of support or add-ons, attachments, and exercise devices. Examples of such devices include barbell supports, dip bars, pull-up bars, and calf squat blocks. These devices connect to the exercise rack through known means via pegs, pins, or bolts that insert into standard attachment holes in the rack itself. Notably, there is currently no such device, add-on, or attachment to support a lifter performing a bent-over row. Thus, there is a need for a device that supports and stabilizes lifters performing the bent-over row exercise (and other exercises) to ensure proper setup and alignment, and reduce the risk of back pain and injury.

BRIEF SUMMARY OF THE INVENTION

Embodiments of the present disclosure may comprise an exercise device adapted to support a lifter performing a bent-over row exercise. The exercise device may include a connecting member having a first arm and a second arm, wherein the first arm connects the connecting member to an exercise rack, the second arm connects the first arm to a supporting unit, and the supporting unit includes an adjustable support pad that is rotatable about a horizontal axis to support a lifter's chest while performing the bent-over row exercise.

The disclosed embodiments may also include a third arm connecting the second arm to the adjustable support pad, wherein the third arm may be rotatable about a horizontal axis so as to adjust the height of the adjustable support pad. For example, in one embodiment, the position of the adjustable support pad may be adjustable to accommodate various sized lifters and various exercises (including, for example, the Pendlaw row, which may require the lifter to assume a lower chest position so that the loaded barbell rests on the floor before each repetition of the exercise is performed). The disclosed embodiments may include a locking member for securing the adjustable support pad in place to prevent against rotation or movement during use.

In another embodiment, the first arm and the second arm may be connected at a pivot point so that the exercise device is collapsible, which allows the exercise device to occupy less space and be stored more easily.

In certain embodiments, the exercise device is part of an exercise system that includes an exercise rack. The exercise device may support a lifter performing various resistance-based, bent-over row exercises, including resistance provided by dumbbells, a barbell, resistance bands, or the like.

In another embodiment, the exercise device is a standalone system that is not attached to an exercise rack. The standalone system may include a base, a first arm, a second arm, and a supporting unit. The base may be configured to rest on the floor. The first and arm and the second arm may extend vertically away from the base to elevate the supporting unit from the base. As in other embodiments, the supporting unit may include an adjustable support pad that is rotatable about an axis parallel to the floor. The base may also include a barbell support configured for receiving a barbell when not in use.

In certain embodiments, the exercise device used is constructed of metal, a composite material, or the like that is rated to support a lifter's body weight under load.

One object of the present disclosure is to provide support, in particular back support, for an individual performing free weight exercises—namely, the bent-over row exercise, for example. By providing an adjustable support for lifter, the lifter may, during use, position his or her chest on the exercise device, thereby supporting their lower back and relieving strain that may otherwise persist when performing bent-over rows. Another object of the disclosed embodiments is to provide safer lifting conditions. The disclosed embodiments are adapted to provide safer exercise conditions by ensuring that lifters are less susceptible to improper form, which often leads to injury.

The embodiments of the present disclosure are believed to be useful in numerous exercises. In addition to row exercises, embodiments of the present disclosure may be used for chest support and increased stability in rear deltoid raises, tricep kickbacks, or any other exercises requiring the lifter to assume a bent-over position that would be aided by the stability provided by the present disclosure.

BRIEF DESCRIPTION OF THE FIGURES

The accompanying drawings, which are incorporated herein as part of this specification illustrate embodiments of the disclosure, and together with the general and detailed descriptions herein provided, serve to explain and illustrate features of the disclosure. References to the following drawings are in no way limiting and are for illustrative purposes only.

DETAILED DESCRIPTION OF THE INVENTION

The below disclosure describes systems and devices for supporting a lifter when performing an exercise. In the following description, for the purposes of explanation and illustration, numerous details are set forth so as to provide an explanation of the present disclosure. It will be evident to a person of ordinary skill in the art, however, that the exemplary embodiments disclosed herein are illustrative only and not limiting or restrictive.

Figure 1:
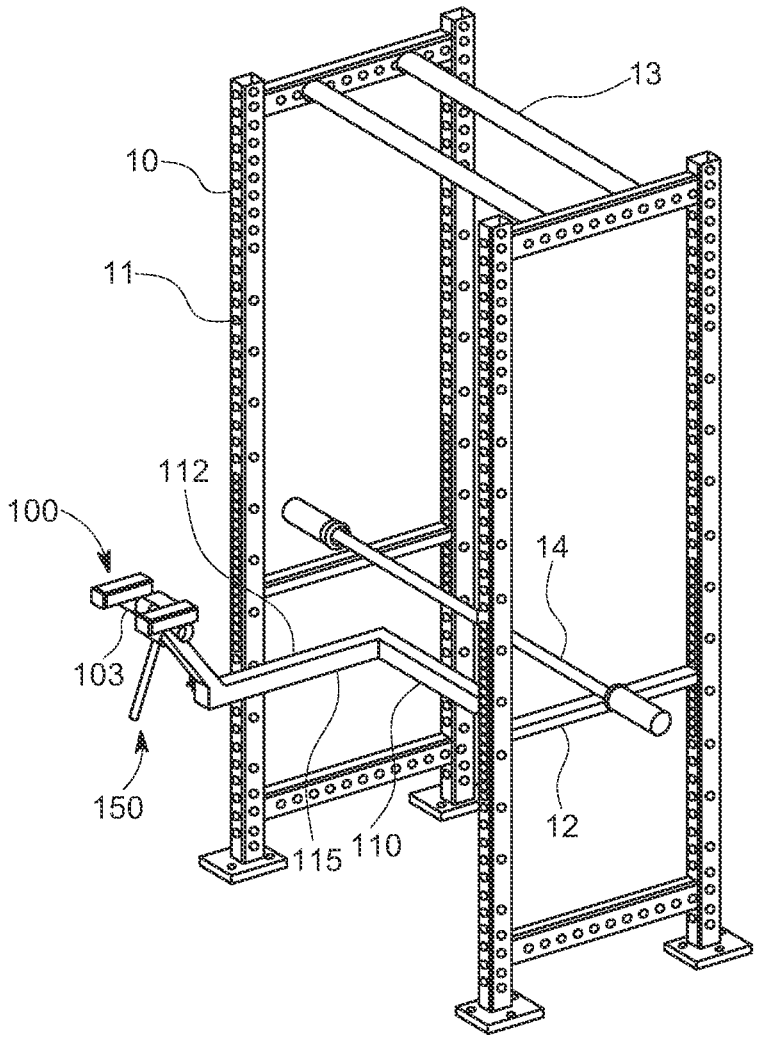
FIG. 1 illustrates an embodiment of the exercise device attached to an exercise rack.

FIG. 1 illustrates an exemplary embodiment of an exercise device 100 for supported bent-over row exercises attached to an exercise rack 10. It will be understood by a person of skill in the art that the exercise rack 10 may also be referred to as an exercise frame, a power rack or cage, a squat rack or stand, a rig, a wall mount, or some equivalent exercise structure. A person of skill in the art will appreciate that the name or composition of the exercise structure is significant only to the extent that it includes a plurality attachment holes 11. The attachment holes 11 are configured to receive pinned add-ons or attachments that connect additional equipment to the exercise rack 10. Such add-ons or attachment are well known and may include, for example, J-hooks for supporting a barbell 14, safety bars 12, and pull-up bars 13.

In some embodiments, the exercise device 100 is configured to support a lifter performing a bent-over row exercise, wherein the exercise device 100 is itself supported by an exercise rack 10. The exercise device 100 may include a connecting member having a first arm 110 and a second arm 112. The first arm 110 may be configured to connect the connecting member to the exercise rack 10 via pins 111 that cooperate with the plurality attachment holes 11. The second arm 112 may be configure to connect the first arm 110 to a supporting unit 150. In some embodiments, the first arm 110 and the second arm 112 are configured to pivot in relation each other where they intersect, thereby giving the exercise device 100 a collapsible feature.

When collapsed, the overall footprint of the exercise device 100 decreases which eases transport and storage of the exercise device 100. In other embodiments, the first arm 110 and the second arm 112 are immovable with respect to one another and are instead integrally formed in one piece. Such construction reduces production costs and strengthens the connection between the first arm 110 and the second arm 112. In the embodiment shown in FIG. 1, the first arm 110 and the second arm 112 are shown intersecting to form a right angle. That configuration, however, is only illustrative and the first arm 110 and second arm 112 may have any configuration in keeping with the scope of the present disclosure.

In some embodiments, the connecting device 101 may also comprise the supporting unit 150, which may include an adjustable support pad 102 that is rotatable about a horizontal axis to support a lifter's chest while performing the bent-over row exercise. In some embodiments, the supporting unit 150 is connected to the second arm 112. The adjustable support pad 102 has an upper surface 103 upon which a lifter's chest rests during use. The rotation of the adjustable support pad 102 about a horizontal axis allows the lifter to assume various bent-over positions. That is, when performing a bent-over row, a lifter may optionally assume various lifting positions to target different muscles. For example, a more upright torso position when rowing tends to activate trapezius muscles, whereas a more bent-over, horizontal torso rowing position tends to more actively engage latissimus dorsi muscles. For instance, the lifter may elect to assume a more upright position wherein the lifter's torso and chest would extend in a direction approximately 45 degrees to the horizontal. Alternatively, the lifter may assume a more bent-over, horizontal torso position, such that the torso and chest would extend in a direction approximately parallel to the horizontal. In either case (whether assuming a more vertical or horizontal torso position), the lifter would rotate the adjustable support pad 102 to align with a given chest position to provide adequate support.

In illustrative FIG. 1, the adjustable support pad 102 is depicted as bifurcated, comprising at least two distinct pads 105, 106. This optional configuration reduces the amount of material used for the exercise device 100. It also allows for independent lateral adjustment of each distinct pad 105, 106. Such adjustability allows lifters with various chest widths and shapes to find the optimal pad position to ensure sufficient support, stability, and comfort. Furthermore, the support pad 102 and upper surface 103 can assume any configuration in keeping with the spirit and scope of the disclosure. For example, in some embodiments, the support pad 102 and upper surface 103, however, can be a single unitary piece. In some embodiments, the support pad may be rectangular, U-shaped, or any other suitable shape. Further, the upper surface 103 of the adjustable support pad 102 contacts the lifter's chest during use and thus may be comprised of a composite foam, plastic, rubber material, or the like to provide comfort and support for a lifter. In some embodiments, the adjustable support pad 102 is a standalone device.

The disclosed embodiments of the exercise device 100 may also include a third arm 114 connecting the second arm 112 to the adjustable support pad 102. The third arm 114 may extend vertically away from the second arm 112, further separating the adjustable support pad 102 from the floor. In some embodiments, the third arm 114 is connected to the second arm 112 via an adjustable arm pivot. The adjustable arm pivot may allow the third arm 114 to rotate about a horizontal axis in order to adjust the position of the adjustable support pad 102. Adjusting the position of the support pad 102 increases the utility of the exercise device 100 by allowing lifters of various heights and sizes to operate the device.

Adjustability also allows lifters to comfortably assume more horizontal torso positions when rowing. Such horizontal torso positions may be desirable when performing certain types of rows, such as, for example, the Pendlay row. Pendlay rows are a bent-over row variation performed with a barbell. To complete one repetition of a Pendlay row, a lifter assumes the bent-over row position (i.e., slight knee bend, pronounced hip bend, and arms extended with barbell in hand) and pulls a loaded barbell from the floor up to the mid-torso before returning the barbell back to rest on the floor. These rows differ from ordinary bent-over rows because each repetition begins with the loaded barbell resting on the floor, which reduces strain on the lower back and allows heavier, more explosive lifting. Alternatively, in some embodiments, the third arm 114 and the second arm 112 may optionally be nonadjustable.

Figure 2:
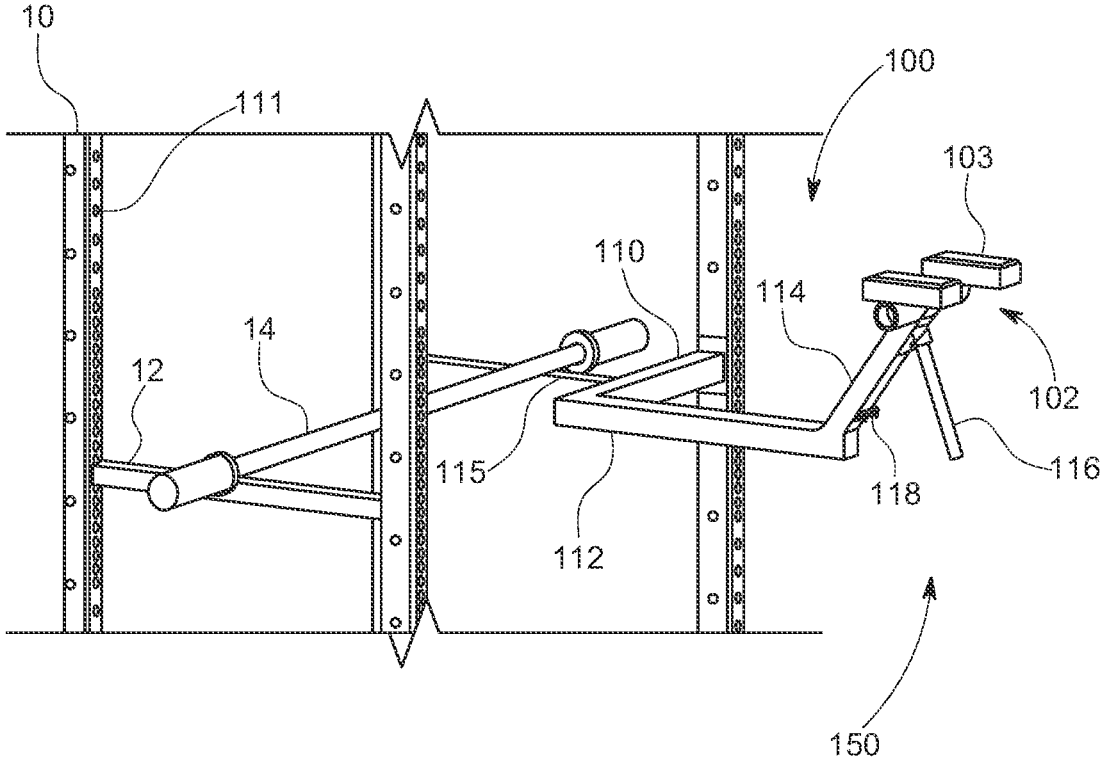
FIG. 2 illustrates another perspective of an embodiment of the exercise device attached to an exercise rack.

In illustrative FIG. 2, another perspective of an embodiment of the exercise device 100 attached to the exercise rack 10 is shown. As illustrated in FIG. 2, the third arm 114 comprises a handle 116 and a handle clip 118. The handle 116 is pivotally attached the third arm 114. The handle 116 is configured for a lifter to grab for support and stabilization when performing a one-arm row, using a dumbbell for example. While performing a one-arm row, the lifter may grab the handle 116 with the hand of the non-lifting arm for support while rowing with the other lifting arm. It will be understood that a lifter may also perform a one-arm row with a resistance band, for example. The handle clip 118 is sized and shaped to receive the handle 116. When performing a bent-over barbell row, the lifter may optionally store the handle 116 within the handle clip 118. In some embodiments, the handle clip 118 may comprise a flexible C-shaped recess that is configured to receive a cylindrical handle 116. However, the handle clip 118 and the handle 116 may assume different configurations, so long as they allow handle 116 to be stored within the handle clip 118.

Figure 3:
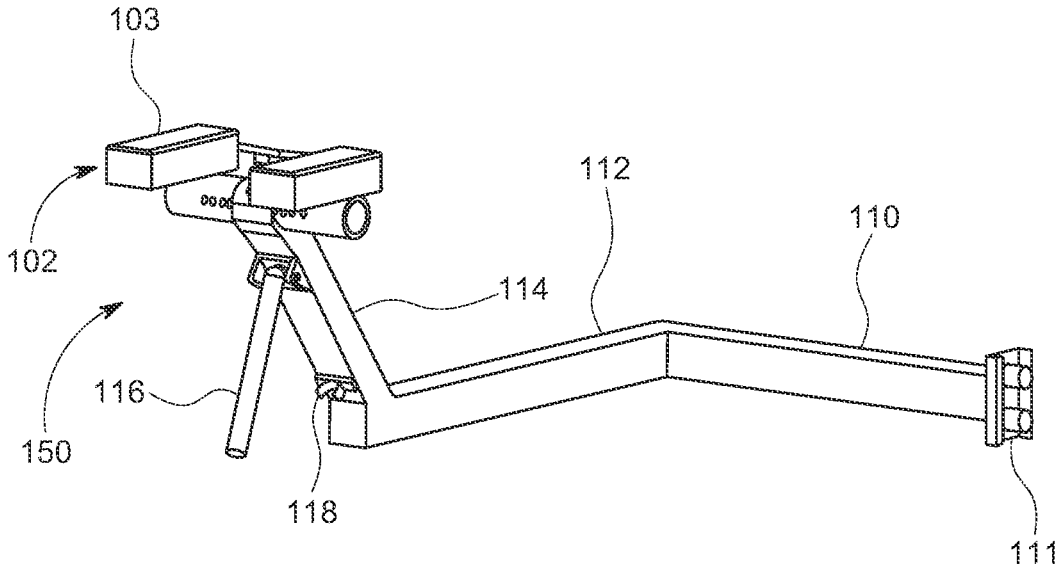
FIG. 3 illustrates an embodiment of the exercise device.

FIG. 3 illustrates another perspective view of an embodiment of the exercise device 100 unattached to the exercise rack 10. As can be seen in FIG. 3, an end of first arm 110 may include pins 111 for connection with the attachment holes 11 of the exercise rack 10. The end of the first arm 110 may optionally include other connecting devices such as clevis pin or the like.

Figure 4:
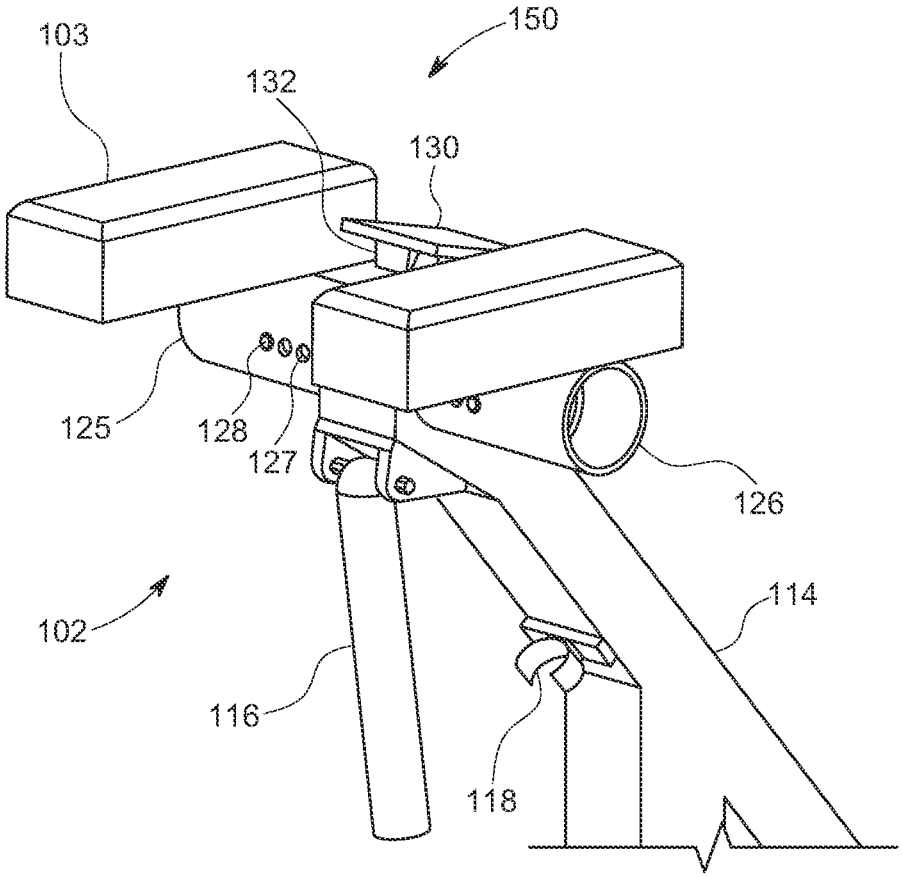
FIG. 4 illustrates an embodiment of the exercise device showing details of the supporting unit, including the adjustable support pad.
Figure 5:
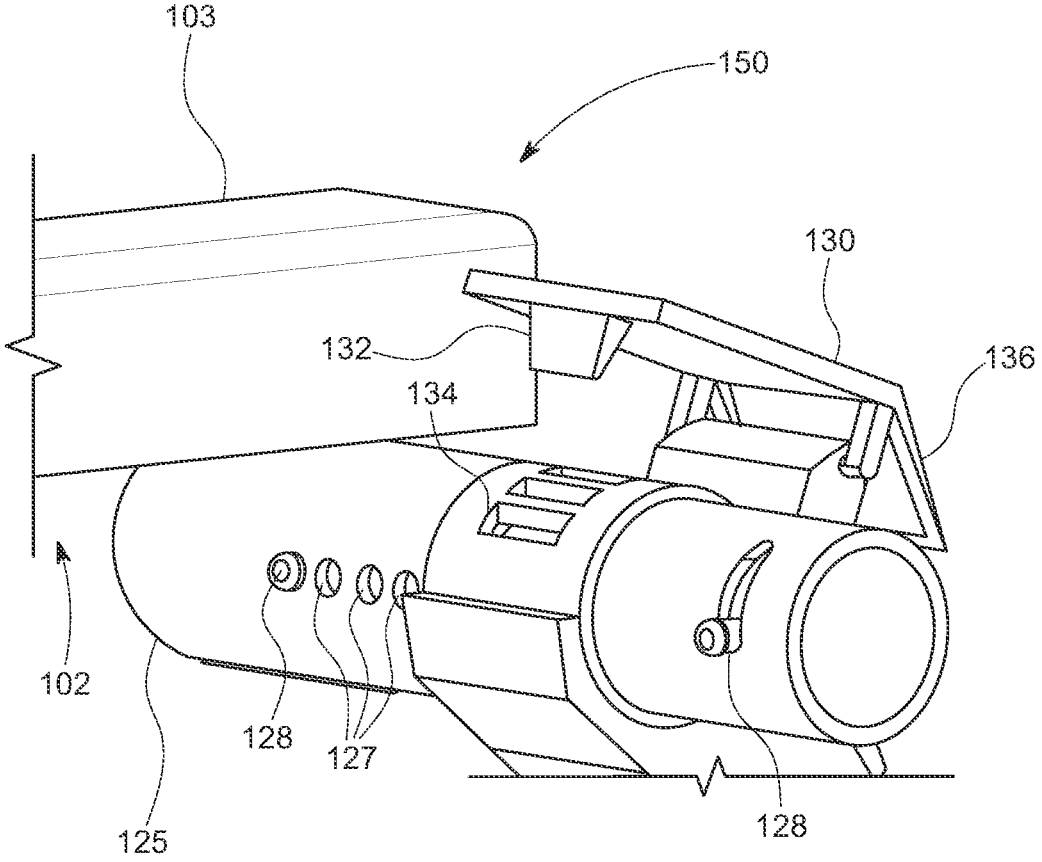
FIG. 5 illustrates an embodiment of the exercise device showing further details of the supporting unit, including the adjustable support pad and the locking device.

In illustrative FIGS. 4 and 5, an embodiment of the exercise device 100 and the adjustable support pad 102 is shown. As explained, in some embodiments, the adjustable support pad 102 may comprise two distinct pads 105, 106 that are configured to slide laterally to adjust their respective positions. To perform this lateral adjustment, distinct pads 105, 106 are secured to respective slides 125, 126 that are configured to move laterally and rotate about an axis extending in the lateral direction. In some embodiments, a locking mechanism is provided to fix the position of slides 125, 126, wherein slides 125, 126 have slide holes 127 for receiving spring latch pins 128 which are biased in an extended, locked position. To move one or both of the slides 125, 126 laterally, the spring latch pin 128 is depressed into its respective slide hole 127 freeing one or both of the slides 125, 126 to move laterally and be repositioned such that the spring latch pin 128 extends outwardly and locks into a different slide hole 127.

Figure 6:
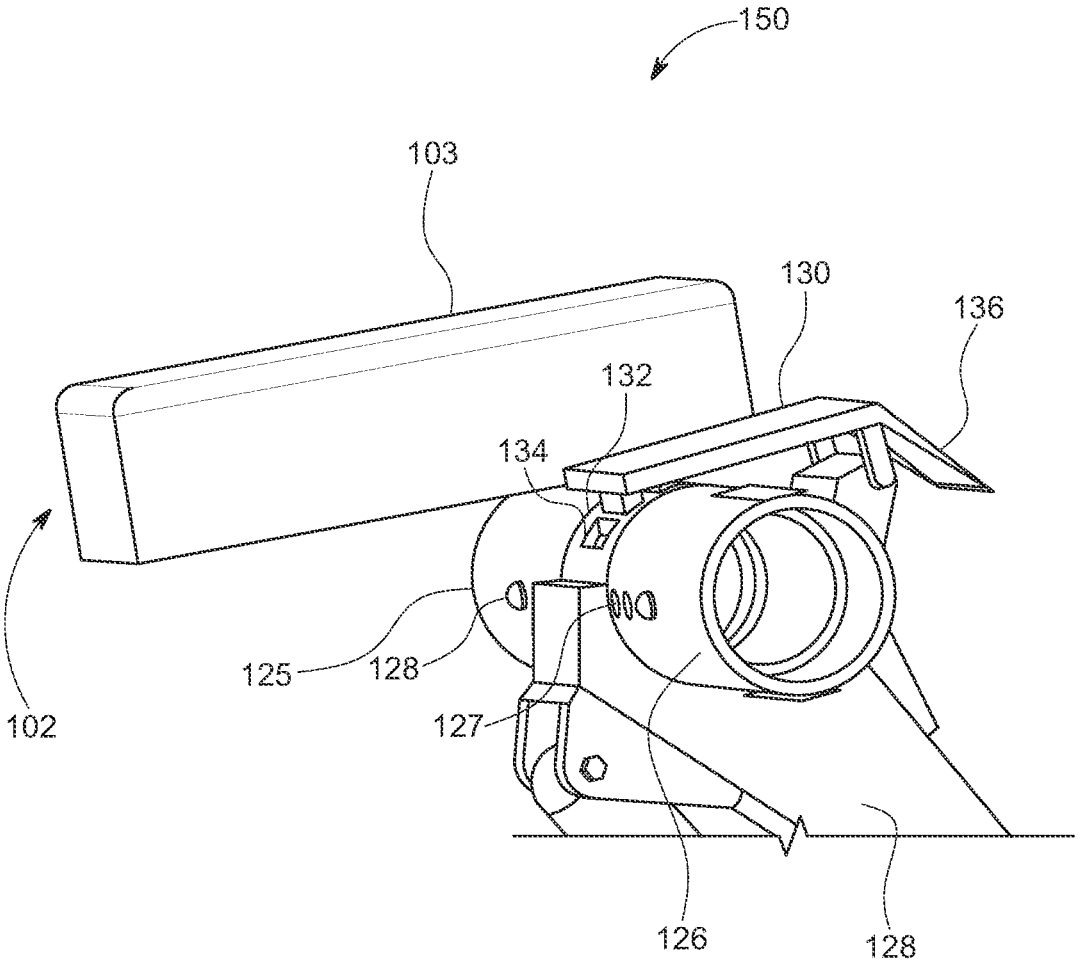
FIG. 6 illustrates an embodiment of the exercise device showing further details of the supporting unit, including the adjustable support pad the and locking device.

In some embodiments, the adjustable support pad 102 is further rotationally locked into a desired position so as to prevent rotation of the adjustable support pad 102 by a locking member 130. The locking member 130 may be pivotally attached to the supporting unit 150 and has on its distal end a locking detent 132 for receipt into a recess 134. When the locking detent 132 is disposed in the recess 134, the adjustable support pad 102 is locked into position and prevented from rotating. An end of the locking member 130 opposite the locking detent 132 may include a grip 136 for moving locking detent 132 out of the recess 134 by pivoting the locking member 130. In some embodiments, the locking member 130 is biased in the locked position so as to provide a secure connection between the locking detent 132 and the recess 134. Illustrative FIG. 6 depicts the locking member 130 in the locked position. In use, to unlock the locking member 130 and rotatably adjust the position of the adjustable support pad 102, a lifter would depress the grip 136, causing the locking detent 132 to be removed from the recess 134, as depicted in illustrative FIG. 5.

Figure 7:
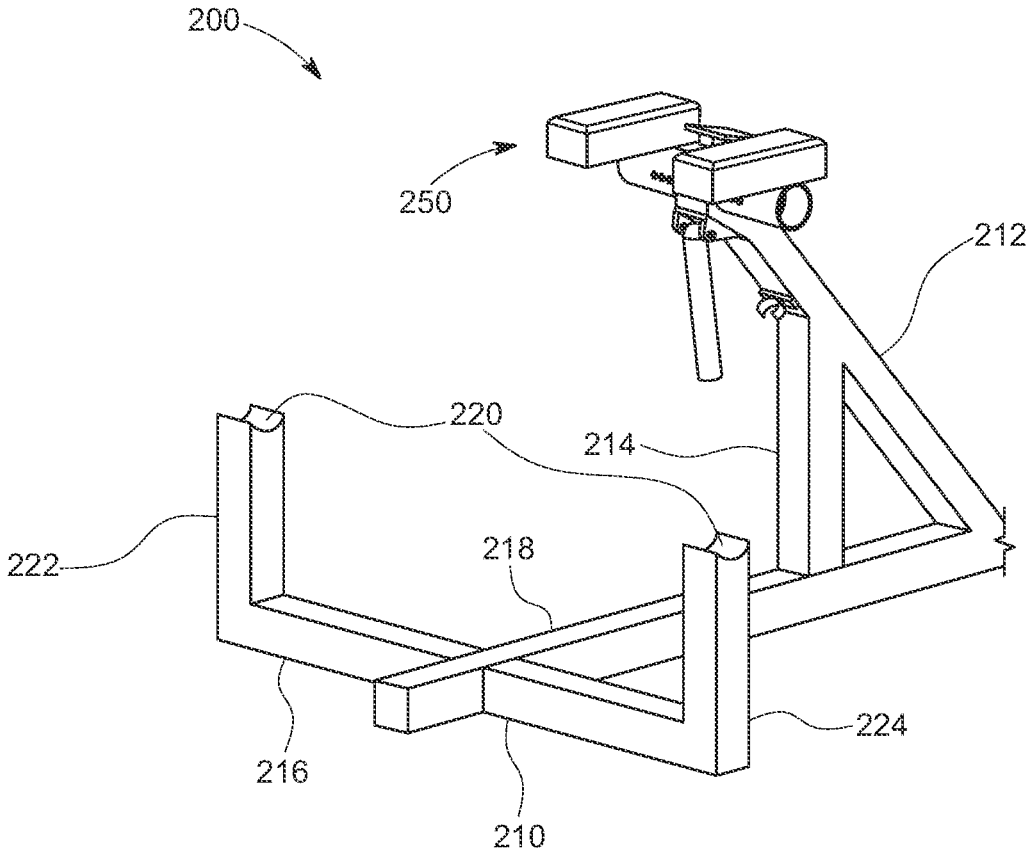
FIG. 7 illustrates another embodiment of the exercise device.

Illustrative FIG. 7 depicts another embodiment of the present disclosure wherein the exercise device 200 is a standalone system that is not attached to an exercise rack 10. The standalone exercise device 200 may include a base 210, a first arm 212, a second arm 214, and a supporting unit 250. The supporting unit 250 may have the same features and components of the supporting unit 150 described in other embodiments. The base 210 may be configured to rest on the floor and is shown in FIG. 7 having cross-shaped configuration comprised of a first base arm 216 and a second base arm 218 to provide stability while utilizing minimal materials. However, it will be appreciated by those of skill in the art that the base 210 can have any suitable configuration in keeping with the scope of the present disclosure.

In one embodiment, the first base arm 216 comprises a barbell support 220 comprised of a first support 222 and a second support 224 positioned at a distance from the first support 222. The first support 222 and the second support 224 are configured to receive a barbell (not shown) and keep it elevated from the floor when not in use. Such a configuration eases the process of loading and unloading weight to and from the barbell.

In an embodiment, the second base arm 218 intersects the first base arm 216. Further, the second base arm 218 is connected to the first arm 212 and the second arm 214, and both the first arm 212 and the second arm 214 extend vertically away from the second base arm 218. The first arm 212 extends vertically at an acute angle from the floor and second base arm 218, whereas the second arm 214 extends vertically at an angle normal to the floor and second base arm. An end of the second arm 214 contacts the first arm 212, thereby supporting the first arm 212 and the supporting unit 250. The standalone exercise device 200 may provides the benefit of not requiring an exercise rack 10 for operation. The standalone exercise device 200 may also have a higher weight capacity because it is more robust than an embodiment that attached to an exercise rack 10 and is supported by the floor as opposed to pins 111.

Although the disclosed embodiments have been described with reference for use in a bent-over row exercise, the device may also be used in other exercise applications, including any exercise performed in a bent-over position that places strain on the lifter's back and requires stabilization, such as tricep kickbacks or rear deltoid raises, for example.

This disclosure is to be regarded as illustrative rather than restrictive. Although the inventive material in this disclosure has been described in detail along with some of its technical advantages, it will be understood that various changes, substitutions, and alterations may be made to the detailed embodiments without departing from the broader spirit and scope of the disclosure as set forth in the following claims. It is further understood that the above description is intended to be illustrative, and neither restrictive or limiting. Many other embodiment will be apparent to those of ordinary skill in the art upon reading and understanding the above description. Although the present disclosure has been described with reference to specific embodiments, it is noted that the disclosure is not limited to the embodiments described or depicted herein. Rather, embodiments of the disclosure can be practiced with modification and alteration not herein mentioned, but otherwise within the spirit and scope of the claims herein provided.

What is claimed is:

1. An exercise device for supporting a lifter performing an exercise, the exercise device comprising:

a connecting member configured to attach to an exercise rack, the connecting member including a first arm and a second arm;

the first arm having a first end and a second end, wherein the first arm first end is configured to attach the connecting member to the exercise rack, and the first arm second end joins the first arm to the second arm;

the first arm having a first arm axis extending in a direction from the first arm first end to the first arm second end;

the second arm has a first end and a second end, wherein the second arm first end is joined to the first arm second end, and the second arm second end is connected to a supporting unit; and the supporting unit having an adjustable support pad, wherein the adjustable support pad has an upper surface configured to support the lifter performing the exercise, wherein the exercise is a bent-over row, and wherein the adjustable support pad is configured to rotate about an axis parallel to the first arm axis.

2. The exercise device of claim 1, wherein the first arm and the second arm are integrally formed as a single continuous piece.

3. The exercise device of claim 1, wherein the supporting unit comprises a third arm connecting the adjustable support pad to the second arm second end;

the third arm having a first end and a second end, wherein the third arm first end is joined to the second arm second end, and the third arm second end is connected to the adjustable support pad.

4. The exercise device of claim 3, an adjustable arm pivot joining the second arm and the third arm at the second arm second end and the third arm first end, wherein the adjustable arm pivot is configured to adjust a vertical position of the adjustable support pad by rotating about the axis parallel to the first arm axis.

5. The exercise device of claim 3, wherein the third arm comprises a handle configured to be gripped by the lifter and a handle clip for receiving the handle, wherein the handle is pivotally attached to the third arm.

6. The exercise device of claim 1, wherein the supporting unit comprises a locking member configured to lock the upper surface of the adjustable support pad in a fixed position.

7. The exercise device of claim 6, wherein the locking member comprises a locking detent and a recess for receiving the detent, wherein when recess receives the locking detent, the upper surface of the adjustable support pad is in the fixed position.

8. The exercise device of claim 1, wherein the adjustable support pad is configured to move laterally in a direction parallel to the first arm axis.

9. The exercise device of claim 1, wherein the upper surface of the adjustable support pad comprises two or more separate surfaces.

10. An exercise system including the exercise device of claim 1, the exercise system further comprising:

attachment holes in the exercise rack configured for attachment of the connecting member.

* * * * *